US006209535B1

(12) United States Patent
Champion

(10) Patent No.: US 6,209,535 B1
(45) Date of Patent: Apr. 3, 2001

(54) HEATING APPARATUS

(75) Inventor: Raymond Champion, Couvin (BE)

(73) Assignee: Thermic Investments, Luxembourg (LU)

( * ) Notice: Subject to any disclaimer, the term of this patent is extended or adjusted under 35 U.S.C. 154(b) by 0 days.

(21) Appl. No.: 09/141,898

(22) Filed: Aug. 28, 1998

Related U.S. Application Data

(60) Provisional application No. 60/078,428, filed on Mar. 18, 1998.

(51) Int. Cl.[7] ..... F24C 3/00

(52) U.S. Cl. ..... 126/85 B; 126/60; 126/73; 126/77

(58) Field of Search ..... 126/58, 60–66, 126/77, 80, 85 B, 85 R, 307 R, 312, 68.73, 76, 144, 146, 151, 147, 152 B

(56) References Cited

U.S. PATENT DOCUMENTS 899,254 * 6/1908 McMorrow ..... 126/65
4,258,692 3/1981 Mackey .
5,119,799 * 6/1992 Cowan ..... 126/65

FOREIGN PATENT DOCUMENTS 553427 5/1923 (FR) .
709454 8/1931 (FR) .
950719 10/1949 (FR) .
1151741 5/1969 (GB) .

* cited by examiner

*Primary Examiner*—James C. Yeung
(74) *Attorney, Agent, or Firm*—Knobbe, Martens, Olson & Bear, LLP

(57) ABSTRACT

A heating apparatus comprises a combustion chamber, formed of an assembly having a rear wall, two lateral walls, an upper wall and a lower wall. The combustion chamber has at least one outlet for flue gases. The walls forming said combustion chamber are configured to have standard dimensions so that the heating apparatus is configurable to operate with a variety of fuels including solid fuels, liquid fuels and gas fuels.

17 Claims, 3 Drawing Sheets

HEATING APPARATUS

This application claims benefit to U.S. provisional 60/078,428 filed Mar. 18, 1998.

FIELD OF THE INVENTION

The present invention is related to a heating apparatus comprising a heating body, also called a combustion chamber, formed of an assembly of several walls, among which are a rear wall closing on the back the heating body, as well as two lateral walls, an upper wall and a lower wall. The combustion chamber also has at least one outlet for the flue gases and possibly a passage in which an air inlet is arranged.

BACKGROUND OF THE INVENTION

A heating apparatus of this kind may be understood as meaning various apparatuses, such as a gas-burning apparatus, especially of the type with a flue or of the air-damper type, a liquid-fuel-burning apparatus, especially with evaporation under pressure or gasification at atmospheric pressure, a wood-burning apparatus and a solid-fuel-burning apparatus. This list is obviously not exhaustive. These apparatuses generally have a rear or back wall which may be made of cast iron, steel, refractory brick or some similar material, and which is attached to the rest of the heating body by means which are known per se. Any sound heating apparatus also requires an oxidizing-air inlet and a flue-gas outlet.

There are also known stoves which, through a change to the internal structure, can be used to burn various types of fuel (see, for example, U.S. Pat. No. 4,258,692 and FR-A-553427).

Finally, there is known a coal-burning heating apparatus, the rear wall of which is formed of three sections, the central section being removable and allowing easy access to, and therefore cleaning of, the flue ducts (see, for example, FR-A-709454).

All these heating apparatuses incidentally have variations in their shape and external appearance in order to meet criteria of fashion and the demands of the users. Indeed, as many of these apparatuses are intended to be situated in habitable rooms, a esthetic criteria come into play in their construction, and these criteria are changing ones.

There is therefore a need to satisfy these demands. However, the effect of this is that it leads to modifying not only the visible part of the heating body, but also at the same time parts of these appliances which are generally not visible, such as the rear wall. Now, the rear wall is fitted with important technical components such as the flue gas discharge, and sometimes a secondary-air inlet of a heat recuperator.

It is also necessary to take into account the fact that the rear wall and the "technical" equipment with which it is provided differ for all the types of heating apparatus, a nonexhaustive list of which was given above. There is obviously a problem with storing different components, mainly the walls and the equipment to be fitted on said walls, the cost of which is not insignificant.

SUMMARY OF THE INVENTION

The main aim of the present invention is to suggest a heating apparatus which has a "universal" combustion chamber which can be adapted to any kind of combustible (liquid fuel, solid fuel, gas, coal or wood) and for which the external design will be adapted according to the user's choice.

A further aim of the present invention would be to suggest a "universal" combustion chamber which could be used for several powers of heating apparatus.

To achieve this, there is provided, according to the invention, a heating apparatus as described above, wherein all the walls forming the combustion chamber of the heating apparatus have standard predetermined dimensions so that such combustion chambers can be used for any model of heating apparatus, irrespective of its power or the fuel it uses.

Furthermore it will be possible, irrespective of the model of domestic stove used, to provide in the rear wall a standard opening that is suitable for all types of heating apparatus. An insert member, which allows for flue-gas discharge, various heat exchanges or draught regulation, is then fitted into the standard opening. The shape of the insert member will correspond to the heating apparatus to be fitted, whether it be of the wood-burning or coal-burning type, or alternatively some other type. Only the shape of this insert member, which is of a small size, will vary in order to accommodate said equipment.

This embodiment is applicable irrespective of the exterior cladding used for the heating apparatuses according to the invention. Such exterior cladding includes: enamelled or lacquered sheet, walls made of plastics, composites, enamelled or lacquered cast iron, ceramic, etc. whether or not the heating apparatuses can be built in, are configured in a tower or in any other shape, with or without a high-level, medium-level or low-level oven, is no longer of any significance.

To sum up, when fashions change, the manufacturer need merely modify the exterior envelope of the stove, while still using the same rear, lateral, upper, and lower walls, and the same opening for stoves of the same power. Thereafter, depending on the intended use of a stove, (that is to say, according to the fuel it is to burn,) an insert member and the corresponding equipment are fitted into the aforementioned opening. For example, at his factory, the manufacturer may thus provide, for all his oil-burning stoves of a given power, an insert member equipped with a heat recuperator which will always be the same, even if the exterior of the stove changes. This obviously results in a quite remarkable ease of storage and in a reduction in the costs of manufacturing, since the technically usable components of the stoves can be mass-produced.

Finally, the power of the heating apparatus can be modified by simply changing the burner, with the same combustion chamber as suggested above.

BRIEF DESCRIPTION OF THE DRAWINGS

Other details and specific features of the invention will emerge from the description given hereafter, with no implied limitation and with reference to the appended drawings.

DETAILED DESCRIPTION OF THE INVENTION

In the various drawings, elements which are identical or analogous are denoted by the same references.

Figure 1:
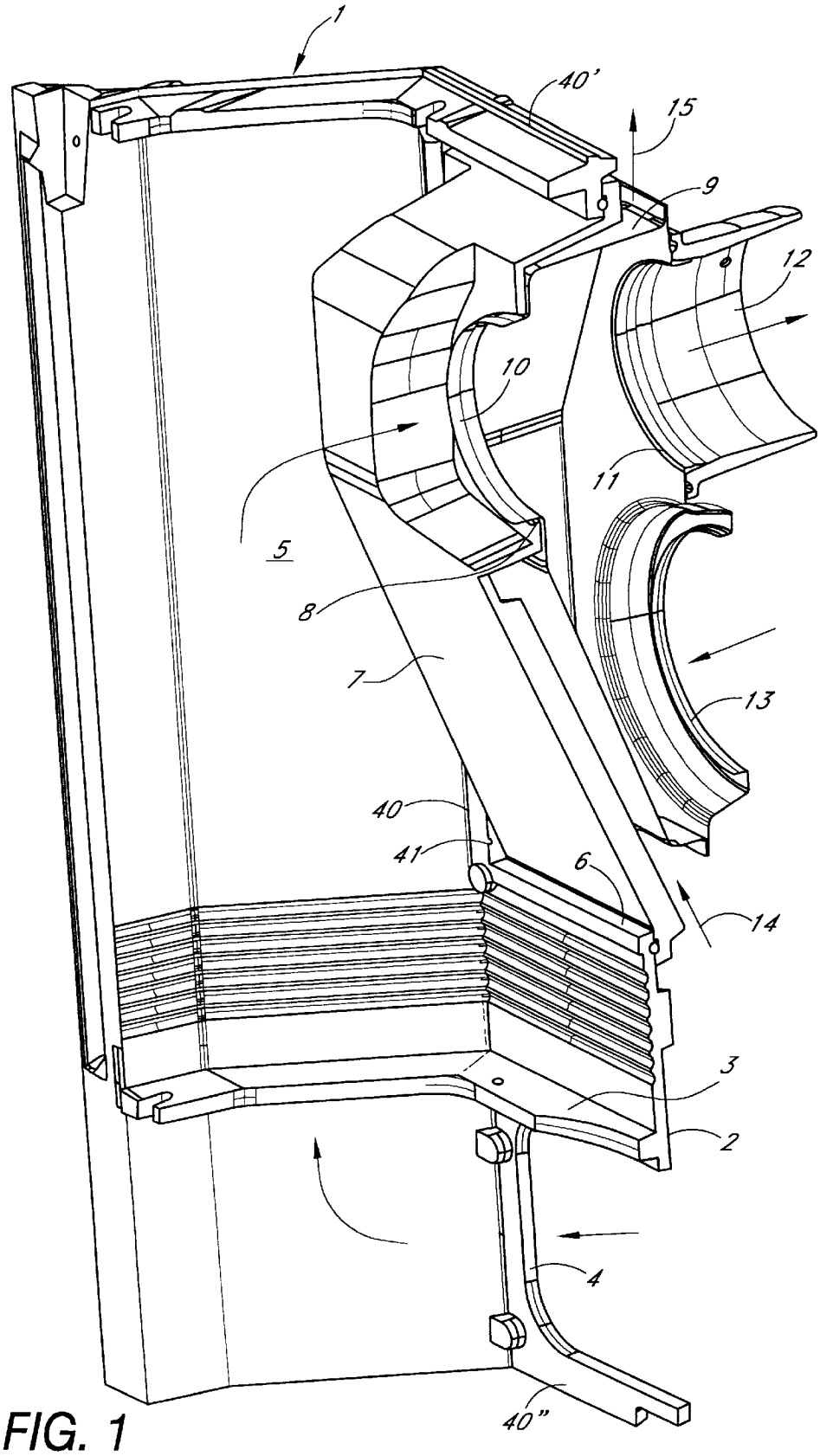
FIG. 1 depicts an axonometric view, with partial cutaway, of the rear of an oil-burning stove according to the invention.

As can be seen from FIG. 1, the heating apparatus depicted is an oil-burning stove 1, the heating body of which comprises several walls. Only a fragment of the rear wall 2 is depicted. This rear wall 2 has a limiting edge 40, 40', 40" and, upon assembly with the other walls of the heating body, is intended to close the heating body at the rear. The interior of this body is, as is known, divided into two via a sole plate 3. The latter supports, toward the bottom, a known pot, not depicted, for gasifying liquid fuel and into which there emerges an oxidizing-air intake. This intake passes through a passage 4 made at the bottom of the rear wall 2.

After combustion, the flue gases escape into the top part 5 of the heating body.

As is clear from the example illustrated in FIG. 1, the rear wall 2 is also provided, in its top part, with an opening 6, the peripheral edge 41 of which is, on all sides, some distance from the limiting edge 40, 40', 40" of the rear wall. This opening has dimensions which are standard for all stoves of the same power. An insert member 7 is fitted into this opening and closes it. The insert member 7 has a through-hole 8 for the flue gases, said hole allowing the interior of the heating body to communicate with flue-gas discharge means.

In this example, the insert member has a shape designed for use in an oil-burning stove supports a casing 9 which comprises a flue-gas inlet opening 10 which is fitted into the through-hole 8 in the insert member 7 and an outlet opening 11 to which, in this instance, there is connected a nozzle 12 which in turn, for example, may possibly be attached to a flue pipe. Such a stove may also be designed without this casing 9 and in this case, the nozzle 12 is connected directly to the through-hole 8.

An additional opening 13 can be seen in FIG. 1 in the lower part of the casing 9, and this opening allows the inside of the casing 9 to communicate with the exterior surroundings. A flap, possibly adjustable, which is not depicted and which acts as a draught regulator or draught damper and which, depending on the circumstances, allows air to enter the casing 9, may be arranged in this opening.

As can be seen in FIG. 1, the casing 9 is supported by the insert member 7 in such a way as to leave a small gap between these two elements. Advantageously, the external face of the insert member 7 is fitted with fins which encourage heat exchange. The insert member 7 thus supports a heat recuperator where air entering at 14 is discharged at 15 having undergone heat exchange by convection.

Depicted in FIGS. 2 to 6 are various stoves which all have an identical structure and in particular all have an identical rear wall. The aforementioned standard opening is made in this identical rear wall. Here, only the insert wall arranged in the standard hole in the rear wall 2 differs according to the flue-gas discharge equipment or heat recuperation systems which are to be supported at the rear of the stove.

Figure 2:
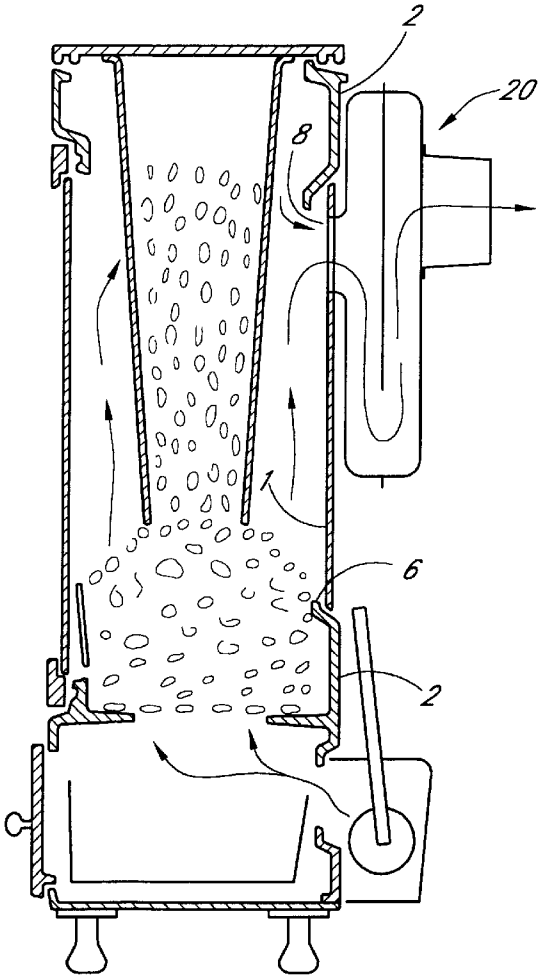
FIG. 2 depicts, diagrammatically, a sectional view through a coal-burning stove according to the invention.

FIG. 2 shows a coal-burning stove which, with the exception of the rear wall, is entirely commonplace. On the rear wall 2 there is a standard opening 6 according to the invention, which is closed off by the insert member 7. The latter is pierced with a through-hole 8 for the flue gases. The insert member 7 supports a cleaning duct 20 which leads toward the flue pipe. If, in the example illustrated, an air inlet is provided at the bottom of the rear wall, it is obvious to the man skilled in the art, that this air inlet is optional and may be omitted in the case of very simple stoves.

Figure 3:
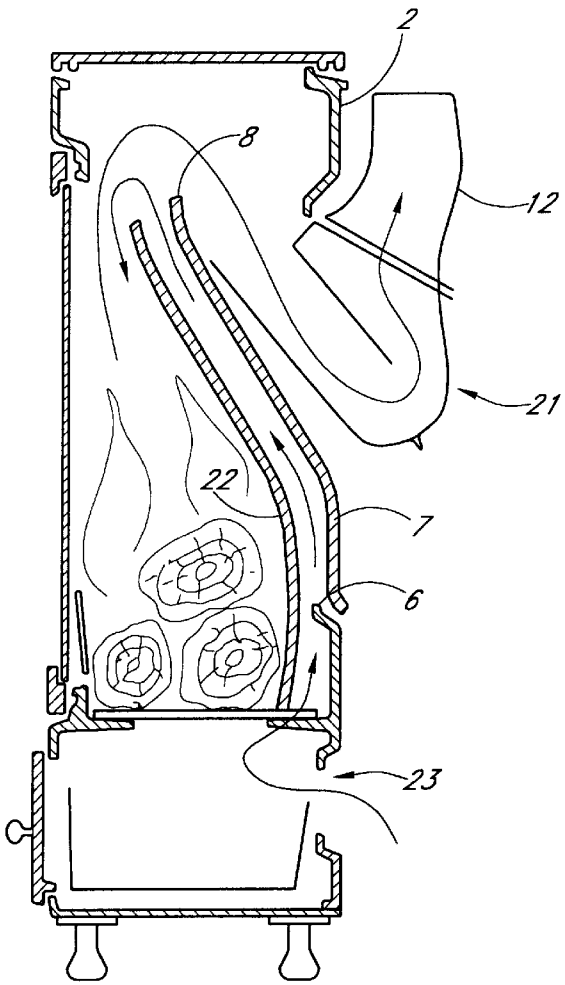
FIG. 3 depicts, diagrammatically, a sectional view through a wood-burning stove according to the invention.

FIG. 3 depicts a wood-burning stove. In the rear wall 2 is the standard opening 6 according to the invention, which is closed off by an insert member 7 which is slightly inclined toward the inside of the stove. The insert member is pierced with a through-hole 8 for the flue gases, in which a heat recuperator 21 may be arranged. At the end of this, there is a nozzle 12 which communicates with any flue pipe there may be.

Here, the insert component 7 supports, on the inside of the heating apparatus, a secondary-air duct 22. The secondary air duct 22 places an adjustable air inlet 23, situated below the combustion chamber, in communication with the top of the combustion chamber.

Figure 4:
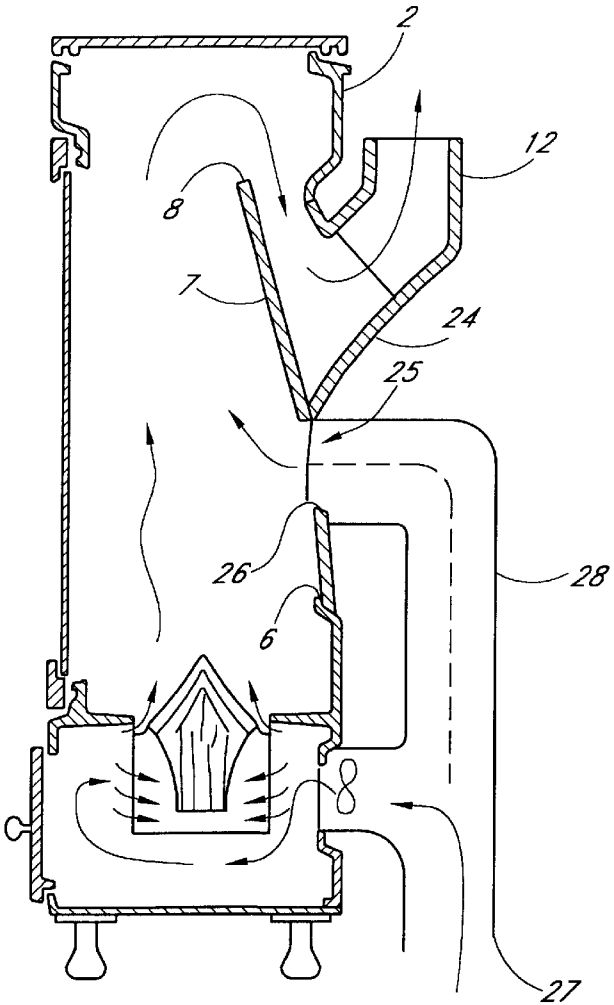
FIG. 4 depicts, diagrammatically, a sectional view through a liquid-fuel-burning stove.

FIG. 4 depicts a liquid-fuel-burning stove. The rear wall 2 has the standard opening 6 according to the invention, which is closed off by an insert member 7 in which a through-hole 8 is provided for the flue gases. An intermediate component 24 guides these flue gases toward a nozzle 12. In this example, the stove may have a draught regulator 25, in the form of a shutter arranged in a lower opening 26 made in the insert member 7. It is possible for this secondary-air inlet to be connected, outside of the stove, to the external-air intake 27, via a communication duct 28.

Figure 5:
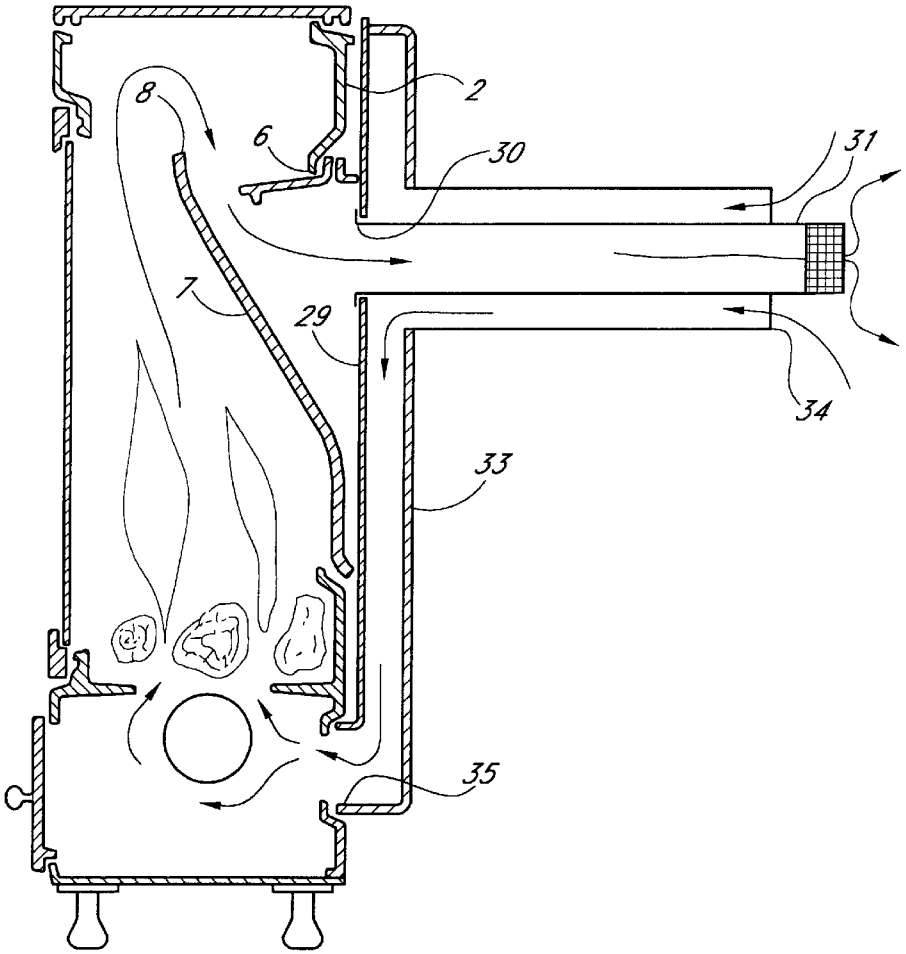
FIG. 5 depicts, diagrammatically, a sectional view through a gas-burning stove of the air-damper type.

FIG. 5 depicts a gas-burning stove of the air-damper type. The rear wall 2 has the standard opening 6 according to the invention, which is closed off by an insert member 7 in which a through-hole 8 is provided for the flue gases. A casing 29 is supported by the insert member. This casing comprises a flue-gas inlet opening 30 and an outlet opening 31 which is, for example, on the outside of the house in which the stove is installed.

This casing 29, known as a smoke box, supports an airbox 33 comprising an air intake 34 and a preheated-air outlet 35. This airbox envelopes the casing 29 and performs heat exchange between the exiting flue gases and the incoming air, from the air intake 34.

From reading the foregoing, it will readily be understood that, for each type of stove, only the exterior housing need be modified, while the standard opening is retained. The insert member and technical equipment which are identical for every stove, are fitted into this standard opening.

It should understood that the present invention is not in any way restricted to the embodiments described above and that many modifications may be made without departing from the scope of the invention defined by the claims that follow.

What is claimed is:

1. A heating apparatus comprising:

a combustion chamber formed of an assembly comprising a rear wall, two lateral walls, an upper wall and a lower wall, said combustion chamber having at least one outlet for flue gases, wherein said walls forming said combustion chamber are configured to have predetermined, fixed dimensions so that said heating apparatus can operate with a fuel selected from the group consisting of solid fuels, liquid fuels and gas fuels;

and wherein said rear wall has an opening and an insert member fitted therein, said insert member having a hole therethrough to allow communication between an interior of the combustion chamber and said outlet.

2. The heating apparatus according to claim 1, wherein the communication between the interior of the combustion chamber and said outlet for the flue gases occurs via flue-gas discharge means.

3. The heating apparatus according to claim 2, wherein the flue-gas discharge means are supported by the insert member.

4. The heating apparatus according to claim 2, wherein the flue-gas outlet comprises a nozzle supported directly by the insert member.

5. The heating apparatus according to claim 4, wherein the nozzle is connected to a flue pipe.

6. The heating apparatus according to claim 2, wherein the flue-gas discharge means are configured as a draught regulator, supported by the insert member.

7. The heating apparatus according to claim 6, wherein the insert member comprises an additional hole in communication with an air inlet, said additional hole configured to receive said draught regulator.

8. The heating apparatus according to claim 2, wherein the flue-gas discharge means are configured as a casing supported by the insert member, said casing comprising a flue-gas inlet opening, which is fitted into said through-hole in the insert member, and a flue-gas outlet opening.

9. The heating apparatus according to claim 8, wherein the casing comprises an additional opening in which a draught regulator is arranged.

10. The heating apparatus according to claim 8, wherein the casing is a heat recuperator.

11. The heating apparatus according to claim 8, wherein the casing is a smoke box.

12. The heating apparatus according to claim 8, wherein the casing is configured to support an airbox comprising a cold-air intake and a preheated-air outlet in communication with an oxidizing-air inlet of the combustion chamber, and wherein the airbox envelops the casing in such a way as to achieve an exchange of heat between the flue gas passing through the casing and the air passing through the airbox.

13. The heating apparatus according to claim 2, further comprising a secondary-air duct which is supported by the insert member, which allows communication between an air inlet and the combustion chamber.

14. The heating apparatus according to claim 1, further comprising fins that facilitate heat exchange, said fins located on an outer surface of the insert member.

15. The heating apparatus according to claim 1, further comprising a passage in the rear wall in which an air inlet is arranged.

16. A heating apparatus comprising a combustion chamber having a rear wall, two lateral walls, an upper wall and a lower wall, said combustion chamber having an outlet for flue gases, said rear wall having an opening therein sized to allow insertion of a combustor adapted to burn fuel selected from the group comprising solid fuels, liquid fuels and gas fuels, and an insert member fitted into the opening and mounted on said rear wall to close the opening, the insert member having an opening therein allowing the flue-gas to communicate with said flue gas outlet.

17. The heating apparatus according to claim 1, wherein the shape of the insert member is determined by the type of fuel used and the power of the heating apparatus.

* * * * *